US008141287B2

(12) United States Patent
Dubois

(10) Patent No.: US 8,141,287 B2
(45) Date of Patent: Mar. 27, 2012

(54) LIGHTWEIGHT, LOW COST SEMI-AUTOMATIC RIFLE

(75) Inventor: Jason R. Dubois, North Smithfield, RI (US)

(73) Assignee: Smith & Wesson Corp., Springfield, MA (US)

( * ) Notice: Subject to any disclaimer, the term of this patent is extended or adjusted under 35 U.S.C. 154(b) by 268 days.

(21) Appl. No.: 12/647,913

(22) Filed: Dec. 28, 2009

(65) Prior Publication Data

US 2010/0162604 A1 Jul. 1, 2010

Related U.S. Application Data

(60) Provisional application No. 61/141,448, filed on Dec. 30, 2008.

(51) Int. Cl.
*F41A 21/00* (2006.01)

(52) U.S. Cl. ..... 42/75.02; 42/75.01; 42/75.1

(58) Field of Classification Search ..... 42/75.01, 42/75.02, 75.1

See application file for complete search history.

(56) References Cited

U.S. PATENT DOCUMENTS

| | | | | |
|---|---|---|---|---|
| 4,515,064 | A | 5/1985 | Hohrein | |
| 4,920,678 | A | 5/1990 | Brown | |
| 5,046,275 | A | 9/1991 | Brown | |
| 5,351,598 | A | 10/1994 | Schuetz | |
| 5,375,359 | A | 12/1994 | Chesnut et al. | |
| 5,461,811 | A | 10/1995 | Ciener | |
| 5,987,797 | A * | 11/1999 | Dustin | 42/75.02 |
| 6,070,352 | A | 6/2000 | Daigle | |
| 6,293,040 | B1 | 9/2001 | Luth | |
| 6,412,390 | B1 | 7/2002 | Dindl | |
| 6,625,916 | B1 | 9/2003 | Dionne | |
| 6,694,660 | B1 * | 2/2004 | Davies | 42/75.01 |
| 7,444,775 | B1 | 11/2008 | Schuetz | |
| 7,716,865 | B2 * | 5/2010 | Daniel et al. | 42/75.02 |
| 7,770,317 | B1 * | 8/2010 | Tankersley | 42/71.01 |
| 8,046,949 | B1 * | 11/2011 | Daniel | 42/75.02 |
| 8,051,595 | B2 * | 11/2011 | Hochstrate et al. | 42/75.01 |
| 2007/0017139 | A1 * | 1/2007 | Larue | 42/75.1 |
| 2007/0033851 | A1 * | 2/2007 | Hochstrate et al. | 42/75.01 |
| 2010/0300277 | A1 * | 12/2010 | Hochstrate et al. | 89/179 |

* cited by examiner

*Primary Examiner* — Michael David

(74) *Attorney, Agent, or Firm* — McCormick, Paulding & Huber LLP

(57) ABSTRACT

A lightweight and low cost semi-automatic rifle includes an upper receiver, a lower receiver, and a forend fabricated from injection-molded polymers. The rifle permits firing .22 LR or similar low-power ammunition from an AR-15 style frame, operates on the blowback principle, and provides a fully functional bolt catch and extractor/ejector/deflector.

18 Claims, 9 Drawing Sheets

LIGHTWEIGHT, LOW COST SEMI-AUTOMATIC RIFLE

CROSS REFERENCE TO RELATED APPLICATIONS

This application claims the benefit of U.S. Provisional Application Ser. No. 61/141,448, filed on Dec. 30, 2008, herein incorporated by reference in its entirety.

FIELD OF THE INVENTION

The present invention relates to firearms and, more particularly, to rifles for sporting use.

BACKGROUND OF THE INVENTION

AR-15 rifles and similarly styled firearms have become a best-selling category of sporting firearms. However, many AR-15s purchased in the civilian market are not used to fire the originally-chambered NATO 5.56 mm round. Instead, a large number of civilian purchasers also purchase conversion kits for re-chambering their AR-15 style rifles. Although conversion kits exist for a variety of calibers and cartridges, the most common kits convert an AR-15 to fire .22 LR ammunition.

While civilian purchasers have many different reasons for wanting to fire .22 LR ammunition from an AR-15 style rifle, the combined cost of rifle and conversion kit easily (and typically) can exceed $1,000. This relatively high price point limits consumer access to an evidently desirable combination of firearm and ammunition. Even for those consumers who already own an AR-15, and seek to economize on the cost of ammunition (.22 LR rounds are significantly less expensive than are .223 or 5.56 mm rounds), the price of the conversion kit can take a long time to pay back.

By contrast, if an AR-15 style rifle designed to fire .22 LR cartridges was available at a lower price point, consumer acceptance of the firearm would be significantly enhanced.

Additionally, existing .22 LR conversion kits for AR-15 style rifles present several technical issues. First, the AR-15 style gas operated action is intended for 5.56 mm rounds, which provide much larger combustion gas volumes than can be obtained from .22 LR cartridges. An AR-15 style rifle not reliant on gas operation would be preferable for use with .22 LR or other low-power ammunition. Second, the AR-15 style cartridge extractor and deflector do not work optimally with .22 LR casings, which are smaller and lighter than 5.56 mm casings. Third, the existing conversion kits may not reliably engage a last-round bolt catch to lock open the bolt when the magazine has been emptied.

Accordingly, a need exists for a lightweight, low cost AR-15 style sporting rifle designed for firing .22 LR rounds.

SUMMARY OF THE INVENTION

The present invention provides a lightweight and low cost AR-15 style sporting rifle, capable of reliably firing .22 LR and similar low-power ammunition. The rifle includes an upper and lower receiver, a forend, a barrel and barrel nut, a frame, an action, a bolt group, and a magazine.

Since the rifle of the present invention is designed for blowback operation using low-power ammunition, rather than for gas operation using relatively high-powered ammunition, the upper and lower receivers are not required to be made from metal. Instead, the upper and lower receivers can be manufactured from injection-molded, fiber-reinforced polymer resins.

In one aspect of the present invention, the lower receiver and frame are injection-molded as a single piece from a fiber-reinforced polymer. The upper receiver and forend are injection-molded as separate pieces for assembly to the lower receiver. Slots formed on inner surfaces of the upper receiver guide assembly of the barrel and the bolt group.

In another aspect of the present invention, the lower receiver and frame are injection-molded as separate pieces to provide for selectably interchangeable frames. The upper receiver and forend are injection-molded as separate pieces for assembly to the lower receiver. Slots formed on inner surfaces of the upper receiver guide assembly of the barrel and the bolt group.

In another aspect of the present invention, the magazine has a lower portion dimensioned to appear as a standard 5.56 mm magazine, and has an upper narrowed portion dimensioned for feeding a .22 LR round into a feed cavity of the upper receiver. The lower receiver includes a magazine well for receiving the narrowed portion of the magazine. A bolt catch is arranged in the lower receiver so as to be engaged by a follower tab of a magazine tray when the magazine has been emptied of ammunition.

In another aspect of the present invention, a recoil spring can be removed from the bolt group without use of tools.

These and other objects, features and advantages of the present invention will become apparent in light of the detailed description of the best mode embodiment thereof, as illustrated in the accompanying drawings.

DETAILED DESCRIPTION OF PREFERRED EMBODIMENTS

Figure 1:
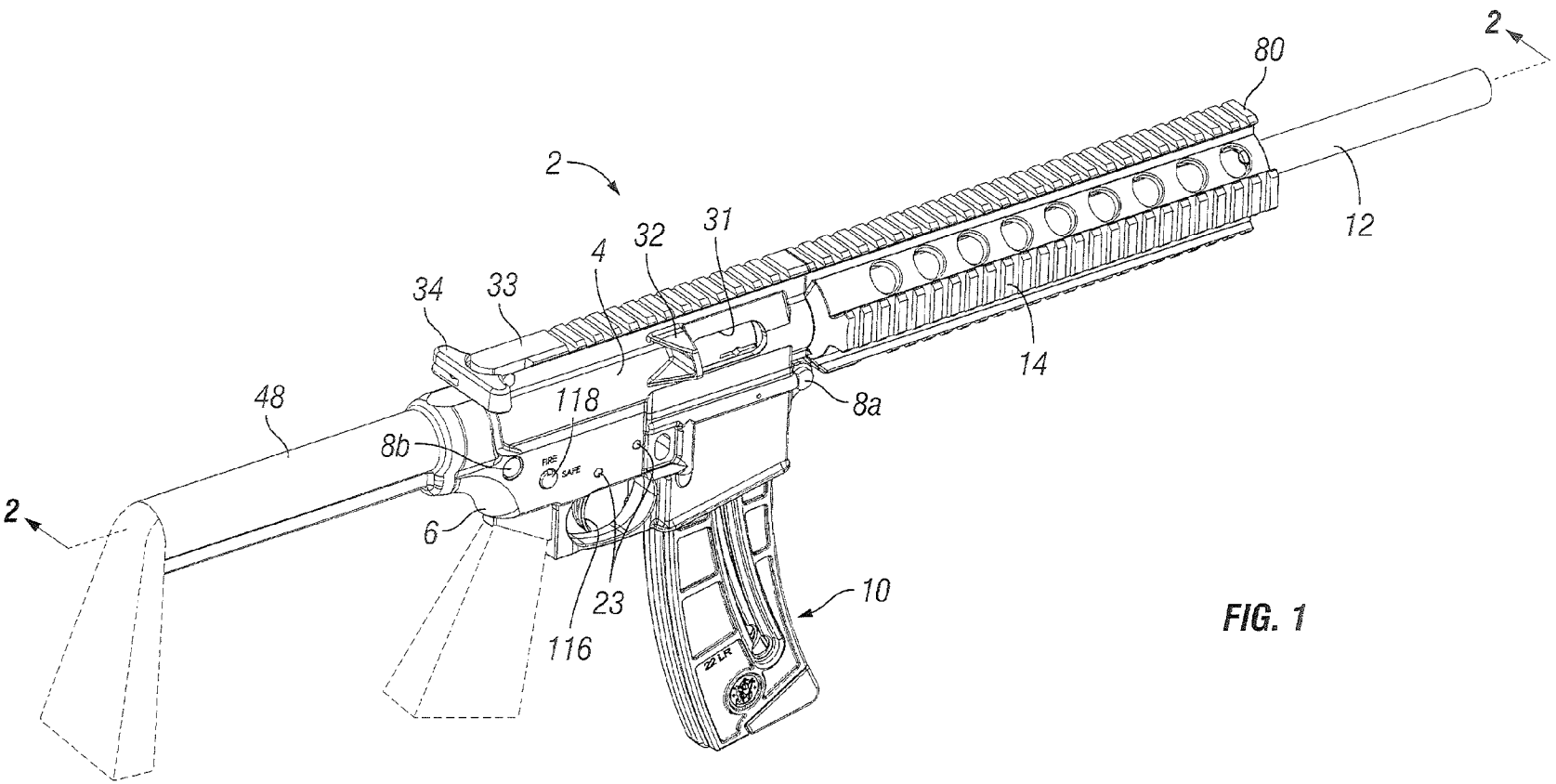
FIG. 1 is a perspective view of a rifle, according to an embodiment of the present invention.

Referring to FIG. 1, an AR-15 style rifle 2, made in accordance with the present invention, is fabricated primarily from polymers. The components of the rifle include an upper receiver 4, a lower receiver 6 assembled to the upper receiver by pins 8*a*, 8*b*, a magazine 10 releasably inserted into the lower receiver, a barrel 12 removably clamped to the upper receiver, and a forend 14 clamped between the barrel and the upper receiver. Preferably, among the aforementioned components only the barrel need be fabricated from metal. Preferably, the barrel is bored from steel rod.

Figure 2:
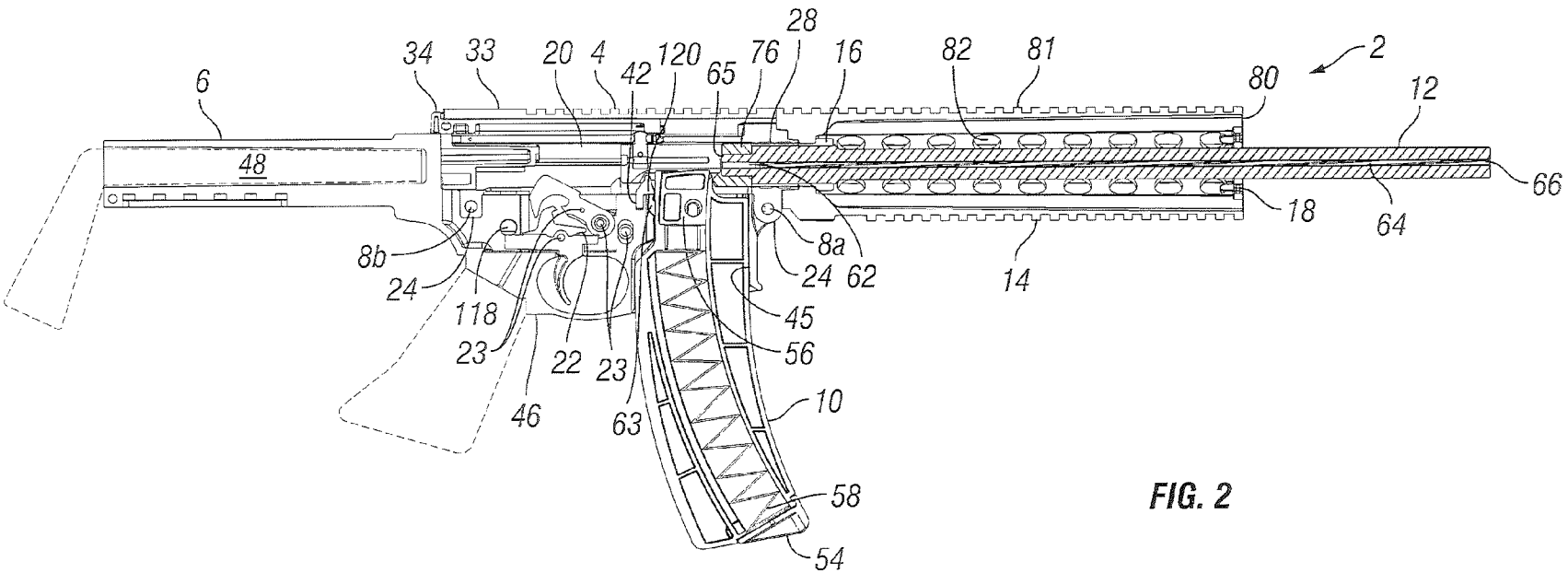
FIG. 2 is a side sectional view of the rifle shown in FIG. 1.
Figure 3:
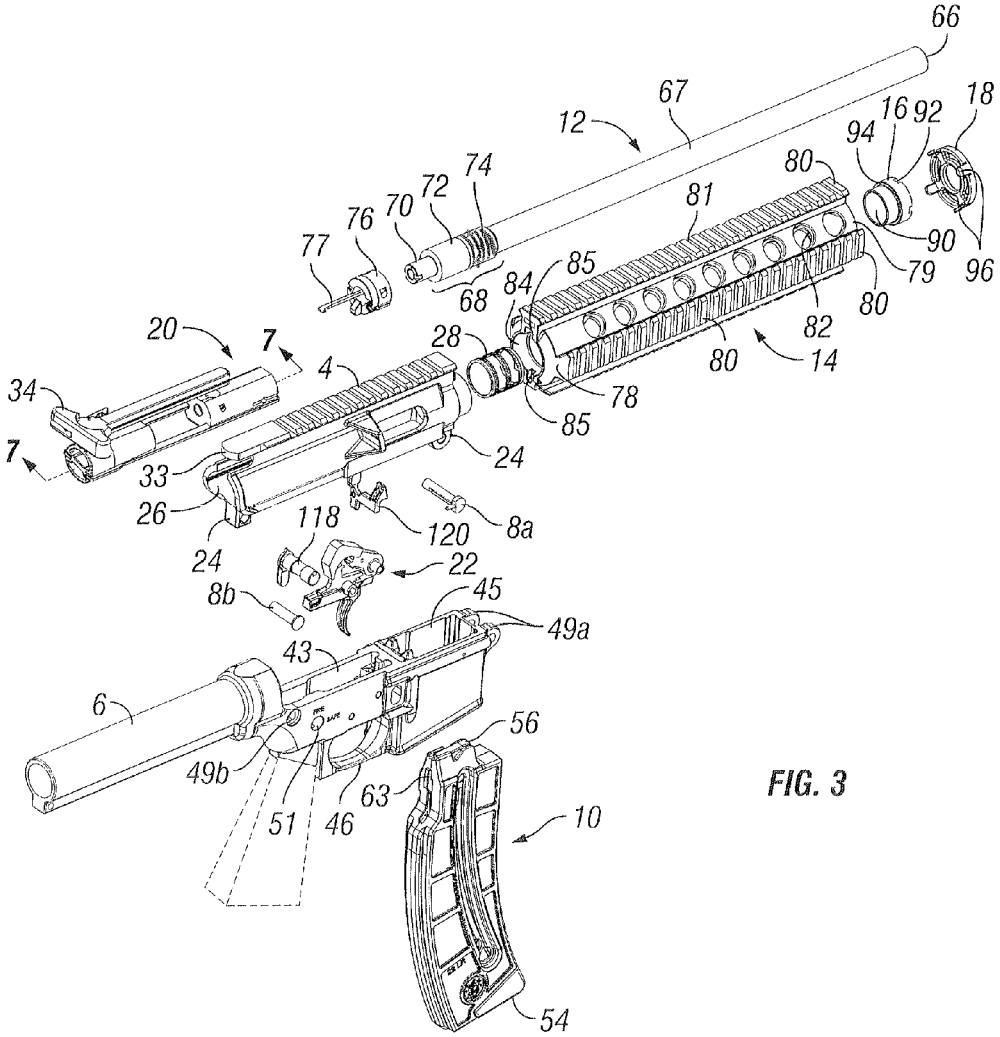
FIG. 3 is a rear perspective exploded view of the rifle shown in FIGS. 1 and 2.

Referring also to FIGS. 2 and 3, the rifle 2 also includes a barrel nut 16 which threadedly clamps the barrel 12 and the forend 14 to the upper receiver 4, and a barrel ring 18 which supports and generally centers the barrel within the forend. The rifle also includes a bolt group 20, which is slidingly housed within the upper receiver, and an action 22, which is pivotally mounted on pins 23 within the lower receiver.

Figure 4:
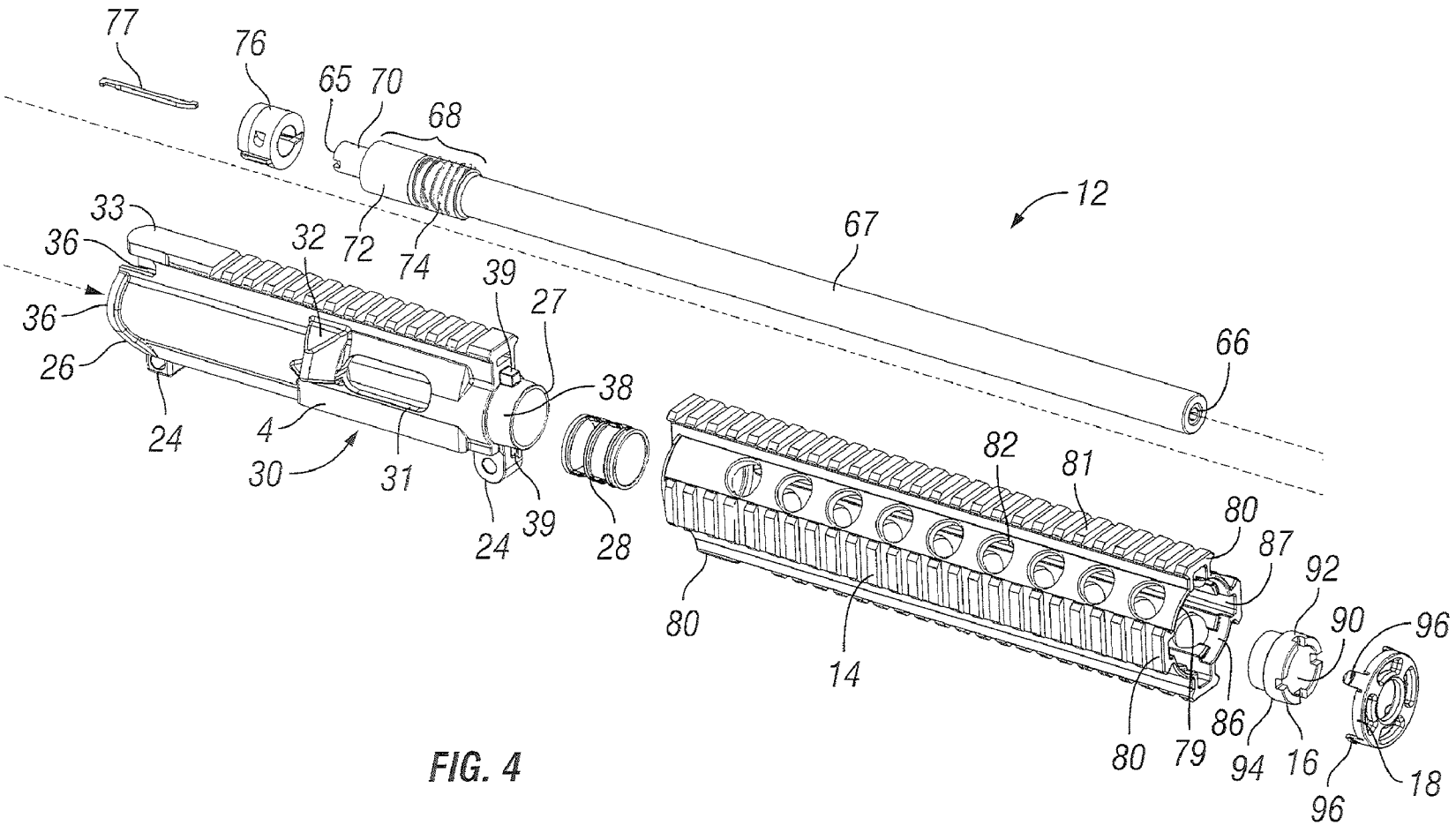
FIG. 4 is a front perspective exploded view of upper components of the rifle shown in FIGS. 1 through 3.

Referring to FIG. 4, the upper receiver 4 includes forward and rearward lugs 24*a*, 24*b* for receiving the assembly pins 8*a*, 8*b* and includes a main portion enclosing a chamber 25 that extends from a rear opening 26 to a breech passage 27. In the embodiment shown in FIG. 4, the breech passage is formed within a breech insert 28 that is molded into the breech end of the upper receiver. The breech insert is fabricated from metal and, preferably, has a knurled outer surface for enhanced engagement of the breech insert into the injection-molded polymer upper receiver. The chamber can be opened along the lower side of the upper receiver at a lower opening 30 extending rearward from the breech passage to the rearward lug 24*b*, as shown in FIG. 4. The upper receiver also includes an ejection port 31 opened laterally from the chamber immediately rearward of the breech passage, and includes a casing deflector 32 protruding outward from the outer surface of the upper receiver immediately rearward from the ejection port. The ejection port and the casing deflector are optimized for the small, light casings of .22 LR ammunition. Optionally, a bolt cover plate (not shown) can be attached to the upper receiver by a spring-hinge disposed above the ejection port. The upper receiver also includes an upwardly-protruding hollow accessories rail 33, which slidingly houses a charging handle 34 connected to the bolt group 20 housed within the bore. When the rifle 2 is fully assembled, the charging handle can be pulled rearward within the accessories rail to retract the bolt group toward a "battery" position at the rear end of the chamber, as further explained below. The hollow accessories rail and the charging handle are dimensioned to prevent trapping ammunition casings during operation of the charging handle.

Figure 5:
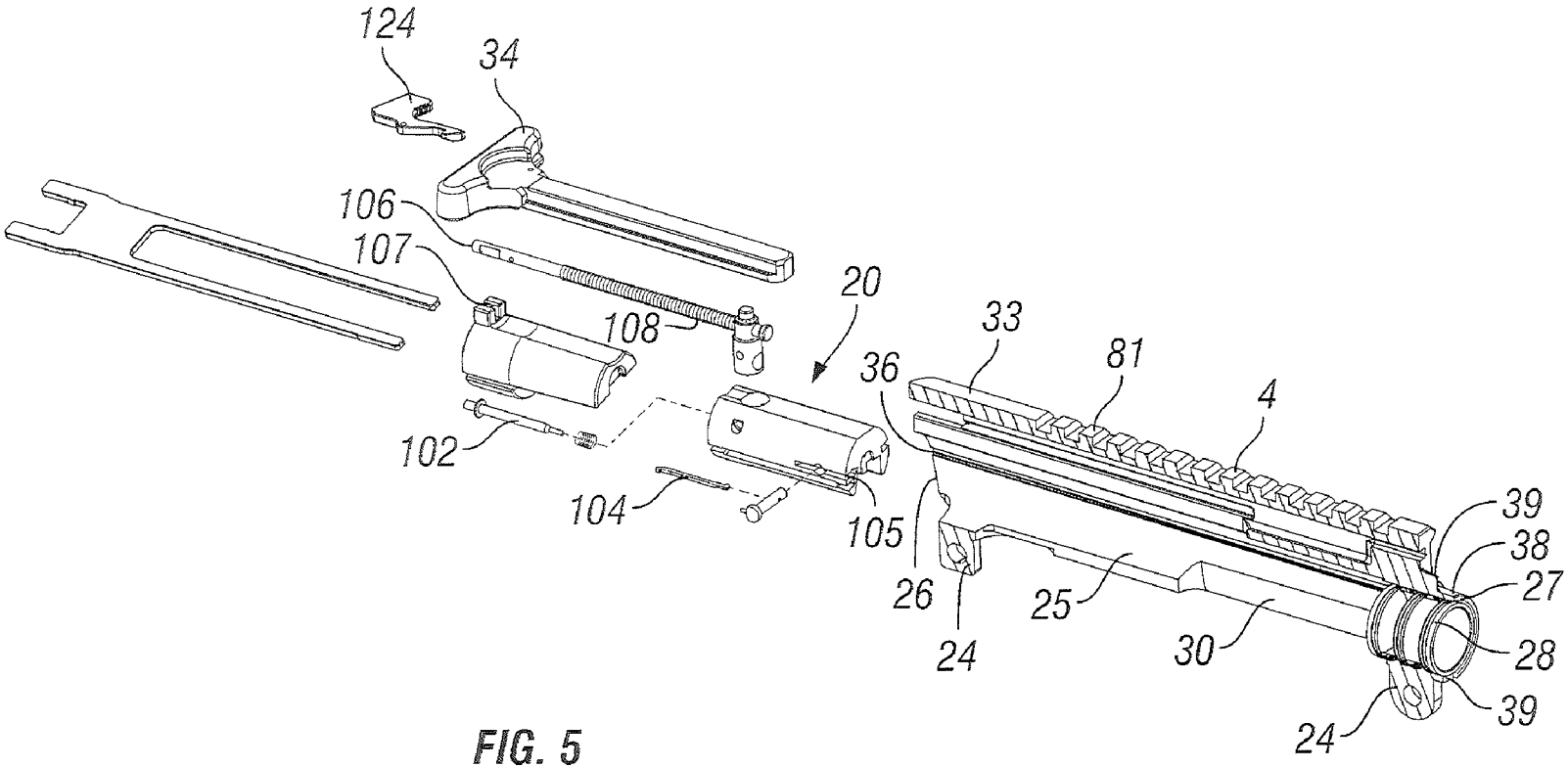
FIG. 5 is a rear perspective exploded view of a bolt group and upper receiver of the rifle shown in FIGS. 1 through 6.

Referring to FIG. 5, along the inner walls of the chamber 25, at least one guide slot 36 is indented from the rear opening 26 to the breech passage 27 for assembly of the barrel 12 and the bolt group 20 into the upper receiver 4, as further explained below. Preferably, two radially-opposed guide slots are formed in the inner walls of the chamber for positive alignment of the barrel and the bolt group with the central axis of the upper receiver. Referring back to FIG. 4, the upper receiver 4 also includes an annular boss 38 protruding forward from the main portion of the upper receiver around at least a forward portion of the breech passage. The annular boss includes asymmetric assembly tabs 39 that protrude radially outward from the annular boss adjacent to the main portion of the upper receiver. The assembly tabs are radially and circumferentially asymmetric for matched assembly of the forend to the upper receiver, and the annular boss and the assembly tabs are tapered along the central axis of the upper receiver for positive alignment of the forend with the barrel and with the central axis of the upper receiver, as further explained below.

Figure 6:
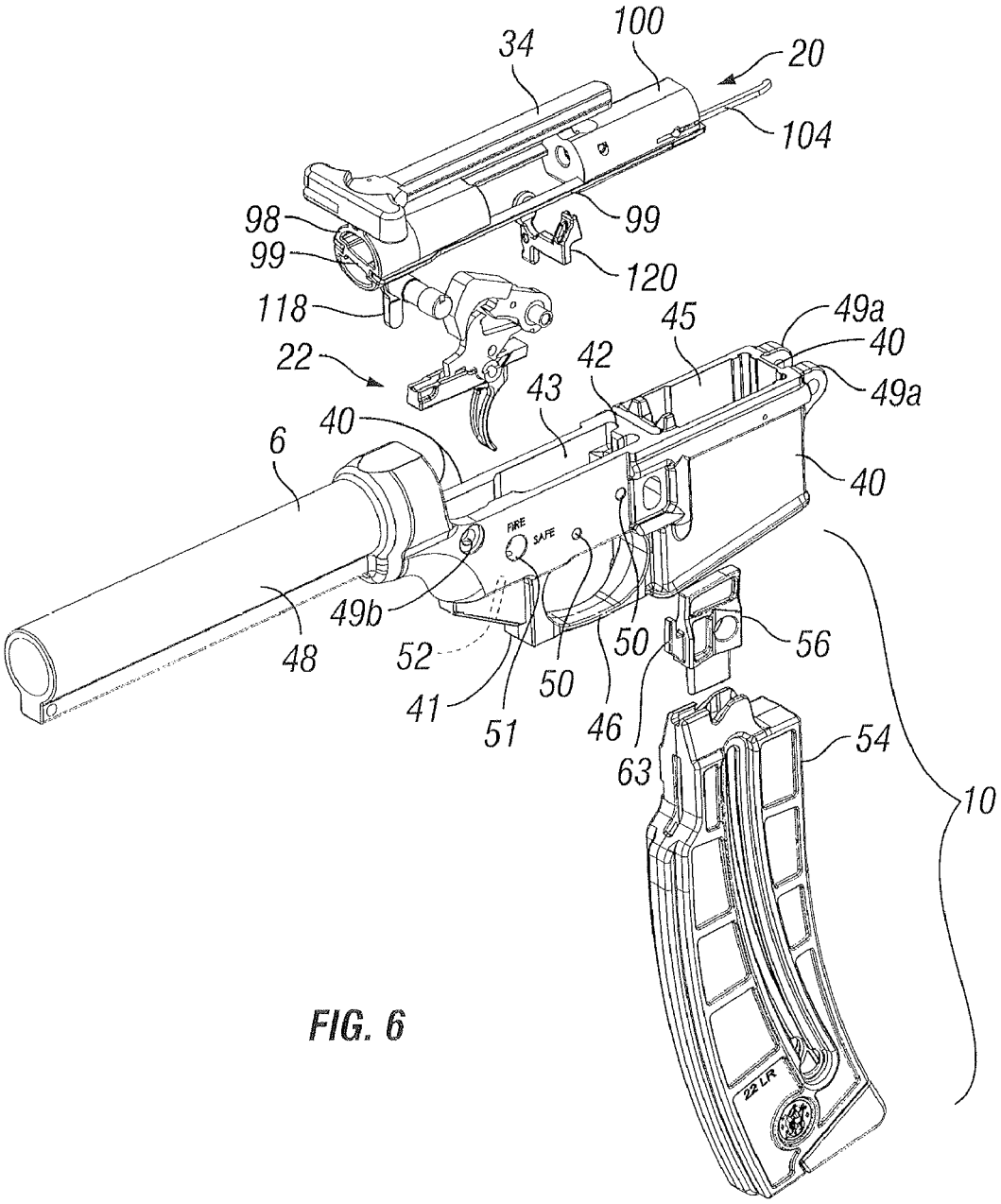
FIG. 6 is a rear perspective exploded view of lower components of the rifle shown in FIGS. 1 through 5.

Referring back to FIGS. 2 and 3, and also to FIG. 6, the lower receiver 6 includes sidewalls 40, a floor plate 41, and a midwall 42, which define a lower cavity 43 with an upward opening rearward of the midwall, a trigger slot 44 opened through the floor plate from the lower cavity, a magazine well 45 opened entirely through the lower receiver forward of the midwall, and a trigger guard 46 extending rearward from the midwall around the trigger slot. The lower receiver also includes a butt tube 48 extending rearward from the rear sidewall for attachment of a stock. The forward sidewall of the lower receiver includes a protruding ear 49*a* with a hole for receiving the forward assembly pin 8*a*. The left and right sidewalls of the lower receiver include mutually-aligned holes 49*b* for receiving the rearward assembly pin 8*b*, pivot-pin holes 50 for receiving the pins 23 for mounting the action 22 within the lower cavity, and mutually-aligned select switch holes 51 opened from the lower cavity. The floor plate of the lower receiver includes a post hole 52 for attachment of a pistol grip or of a sporting stock. The lower cavity is opened along the upper side of the lower receiver for interaction of the action 22 with the bolt group 20, and the magazine well is opened at the lower side for insertion of the magazine 10 and at the upper side for interaction of the magazine with the bolt group.

Still referring to FIGS. 2 and 3, and also to FIG. 6, the magazine 10 includes a case 54 which houses a follower 56 driven upward by an accordion spring 58, as well known in the art. The magazine is dimensioned to deliver .22 LR cartridges into the chamber 25 while presenting the outward appearance of a standard 5.56 mm magazine. Thus, the case of the magazine is generally similar in outline to a standard 5.56 mm NATO magazine, however the case of the magazine also includes a necked upper portion 60 to which the follower conforms. The necked upper portion of the magazine case fits closely within the magazine well 42 of the lower receiver, so that a .22 LR cartridge 62 supported on the follower will be substantially aligned with the axis of the barrel 12 when the magazine is properly inserted into the magazine well. The follower includes a rearwardly protruding hook 63 for interaction with the action 22, as further explained below.

Referring to FIGS. 2 through 4, the barrel 12 encloses a rifled bore 64 extending along the axis of the barrel from a breech end 65 to a muzzle end 66 of the barrel. The barrel includes a main portion 67 of generally constant outer diameter extending breechward from the muzzle end to an enlarged portion 68, and also includes a reduced-outer-diameter portion 70 extending from the enlarged portion to the breech end of the barrel. The enlarged portion includes a smooth region 72 adjacent to the reduced-outer-diameter portion of the barrel, and also includes an externally-threaded region 74 adjacent to the main portion of the barrel outer surface. The barrel is assembled with a breech sleeve 76, which fits over the reduced-outer-diameter portion of the barrel to define a shoulder standing radially outward from the enlarged portion of the barrel. The breech sleeve captures an ejector hook 77 against the reduced-outer-diameter portion of the barrel so that the ejector hook protrudes rearward from the breech end of the barrel. When the barrel is assembled into the upper receiver 4, as shown in FIGS. 1 and 2, the smooth region of the enlarged portion of the barrel fits snugly into the breech insert 28, and the shoulder of the barrel is clamped against a rearward end of the breech insert by threading the barrel nut 16 onto the externally-threaded portion of the barrel so that the barrel nut contacts a forward surface of the breech insert, as best shown in FIG. 2.

Still referring to FIGS. 2 through 4, the forend 14 is an annular shell extending from a breech end 78 to a forward end 79, and is formed to include longitudinal accessories rails 80 with lateral ratchets 81. The forend is penetrated by a plurality of cooling perforations 82 disposed between the accessories rails. The breech end of the forend includes a circular indent 84 with tapered assembly indents 85 extending outward therefrom for receiving the upper receiver circular boss and assembly tabs. The forward end of the forend includes a shallow recess 86 with notches 87 for receiving the barrel ring 18, which keeps the barrel generally centered in the forend and prevents the barrel from deflecting under impact loads. Alternative forend designs can be interchanged as long as the breechward end of the forend matches the forward end of the upper receiver.

Referring to FIGS. 2 and 5, the barrel nut 16 includes a threaded inner surface 90 complementary to the threaded region 74 of the barrel 12, a crenellated forward face 92 for receiving a barrel nut tool (not shown), and a substantially flat rear face 94 for clamping the forend 14 and the upper receiver 4 against the forward surface of the breech sleeve 76 to provide an upper subassembly, to which the lower receiver 6 can be pivotally pinned by the forward pin 8*a* to provide a rifle frame. The remaining components then can be assembled into the rifle frame to provide the rifle 2. The barrel ring 18 includes a flat body and three or more prongs 96 extending from the flat body of the ring for clipping the ring into the forend 14.

Figure 7:
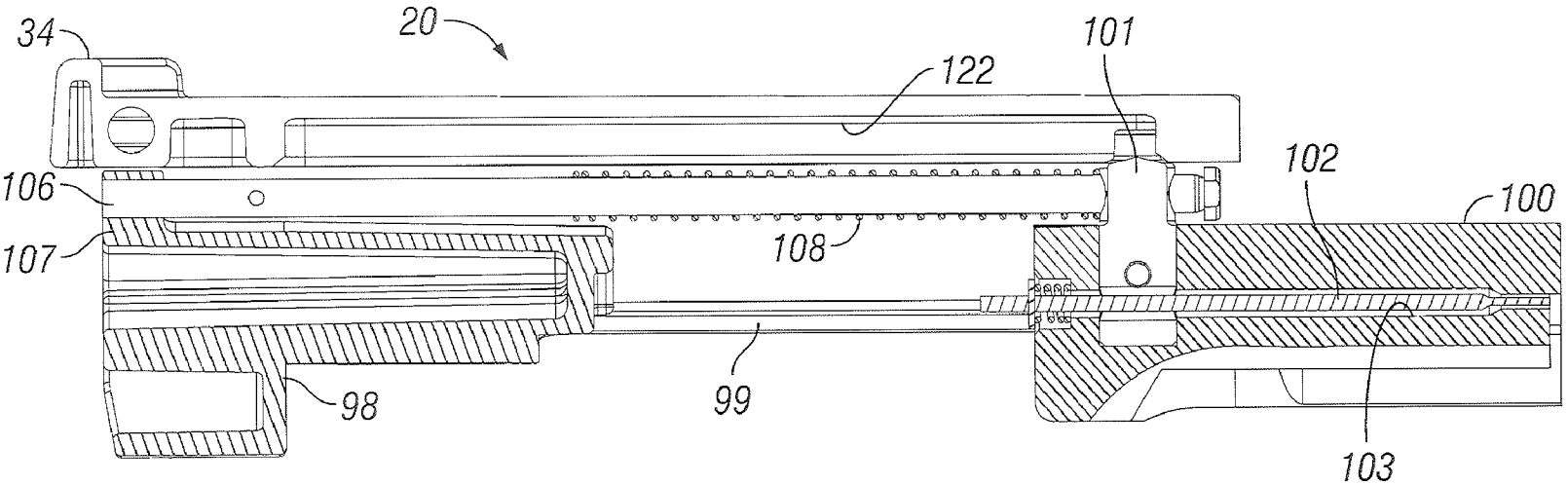
FIG. 7 is a side sectional view of the bolt group shown in FIG. 7.

Referring to FIGS. 5 through 7, the bolt group 20 includes a buffer 98, guide rails 99 clipped into grooves formed along the sides of the buffer, a bolt 100 slidingly mounted on the guide rails, a recoil nut 101 protruding from an upper surface of the bolt, a firing pin 102 slidingly housed within a pin cavity 103 formed through the bolt and the recoil nut, an extractor claw 104 movably mounted within a longitudinal slot 105 formed on an outer surface of the bolt, a recoil rod 106 slidingly housed within the recoil nut and clipped between lugs 107 formed on the buffer, and a recoil spring 108 captured on the recoil rod between the buffer and the recoil nut. When the bolt group is assembled, the outward pressure of the recoil spring against the bolt and the buffer engages the bolt and the buffer with the recoil rod and the guide rails and holds the bolt in a "battery" position at the far end of the guide rails from the buffer. The bolt is movable along the guide rails to compress the recoil spring into a "charged" condition where the bolt is close to the buffer.

Figure 8:
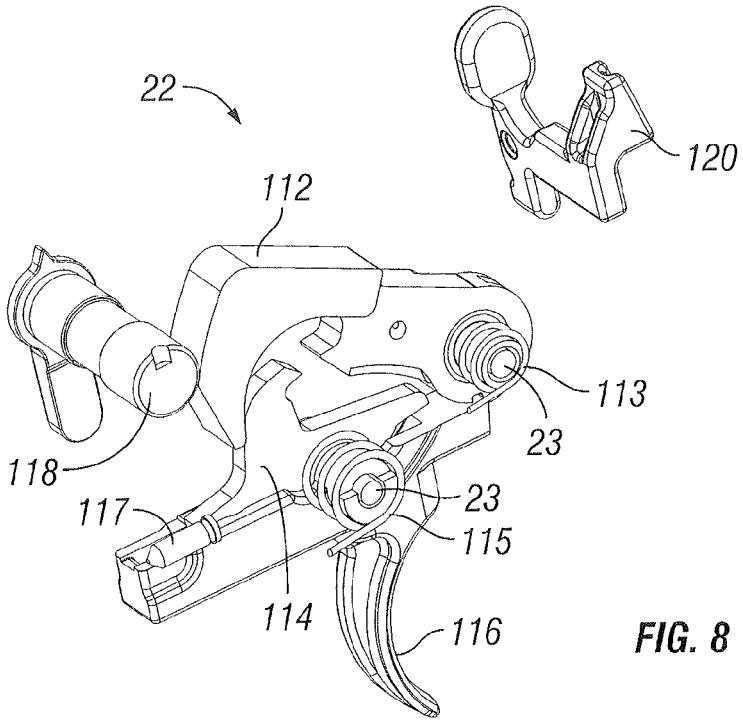
FIG. 8 is a rear perspective view of an action group of the rifle shown in FIGS. 1 through 6.

Referring to FIG. 8, the action 22 includes a hammer 112, a hammer spring 113, a sear 114, a sear spring 115, a trigger 116, all of which are mounted to the sidewalls 40 of the lower receiver 6 on the pivot pins 23, a safety pin 117 slidingly contacting the trigger, a safety switch 118 mounted through the select switch holes 51 of the lower receiver, and a bolt catch 120 pivotally mounted in the midwall 42 of the lower receiver. As well known in the art, the hammer spring is captured between the hammer and an inward protrusion or groove of the receiver sidewall and biases the hammer toward a discharged position for driving the firing pin 102 against the rim of a chambered round 62. The sear spring is similarly captured between the sear and the receiver sidewall and biases the sear to a locked position wherein the sear restrains the hammer in a cocked position away from the firing pin. The trigger is pivotable to push the sear out of the locked position, thereby releasing the hammer from the cocked position. The safety switch includes a catch or cam and can be pivoted within the select switch holes so as to engage the catch or cam with at least one of the other action components so as to prevent release of the hammer from the cocked position. The bolt catch is disposed so as to pivot downward into the magazine well 45, but when an empty magazine 10 is inserted into the lower receiver 6, the protruding hook 63 of the magazine follower 56 pivots the bolt catch upward to latch the bolt 100 into the charged position.

Referring back to FIGS. 2, 5, and 7, the charging handle 34 is assembled to the bolt group 20 by engaging a longitudinal slot 122 formed in the underside of the charging handle with the recoil nut 101 formed on the bolt 100. The charging handle is held together with the bolt group when the bolt group and the charging handle are assembled into the chamber 25 and the hollow accessories rail 33, respectively. The charging handle includes a spring latch 124, which releasably captures the charging handle within the hollow accessories rail when the bolt is in the battery position described above. When the spring latch is squeezed the charging handle can be pulled rearward to "charge" the recoil spring 108; releasing the charging handle then permits the recoil spring to drive the bolt forward to the battery position.

Figure 9:
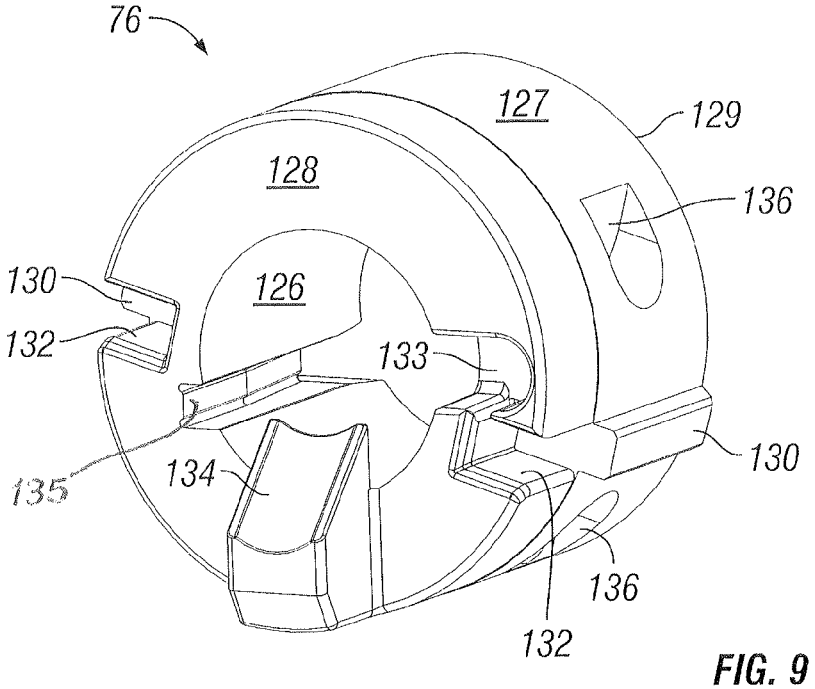
FIG. 9 is a rear perspective view of a breech sleeve of the rifle shown in FIGS. 1 through 4.

Referring to FIG. 9, the breech sleeve 76 is a hollow cylinder having an inner surface 126 and an outer surface 127 extending from an annular chamber face 128 to an annular barrel face 129. The inner surface of the breech sleeve is dimensioned to receive the reduced-outer-diameter portion 70 of the barrel 12, and the outer surface of the breech sleeve is dimensioned to fit within the chamber 25 of the upper receiver 4. The breech sleeve inner surface includes a longitudinally-extending ejector hook groove 135 for capturing the ejector hook 77 against the barrel when the breech sleeve and the barrel are assembled together. The breech sleeve outer surface includes radially protruding guide ribs 130 that extend from the barrel face toward the chamber face. The guide ribs are dimensioned to fit within the guide slots formed along the inner surface of the chamber. The breech sleeve outer surface also includes radially indented guide notches 132 that extend from the chamber face toward the barrel face. The guide notches are dimensioned to receive the guide rails 99 of the bolt group 20. The chamber face of the breech sleeve includes an extractor claw notch 133 for receiving the extractor claw 104 when the bolt 100 is disposed adjacent to the chamber face, and also includes a feed ramp 134 protruding rearward and inward from the chamber face of the breech sleeve. The feed ramp has an inner end disposed radially inward from the inner surface of the breech sleeve and has a slightly concave upper surface leading outward and rearward from the inner end to an outer end of the feed ramp. With a loaded magazine 10 inserted into the magazine well 45 of the lower receiver 6, the outer end of the feed ramp is disposed relative to the magazine such that, as the bolt 100 moves from the charged position to the battery position, the feed ramp guides a cartridge 62 from the magazine into the rifled bore 64. The breech sleeve outer surface includes pre-drills 136 to provide for pinned or clamped attachment of the breech sleeve to the reduced-outer-diameter portion of the barrel. Alternatively, the breech sleeve can be threaded or welded onto the reduced-outer-diameter portion of the barrel. Integrally forming the breech sleeve with the barrel is less preferred, because unexpectedly significant cost savings can be achieved by forming the complex surfaces and larger diameter of the breech sleeve separately from the bore, rifling, and external threads of the barrel.

At least the barrel 12, the barrel nut 16, the breech insert 28, and the breech sleeve 76 should be fabricated from steel or other suitable metals. Other parts of the rifle 2 can be fabricated of any suitable materials—preferably a fiber-reinforced, injection-molded polymer for external parts, and sintered or injection molded metals for internal parts. Preferably, the breech insert is molded into the injection-molded upper receiver, in which case axial and radial alignment of the breech insert to the upper receiver guide slots is an important aspect of the molding process.

The barrel 12 and the forend 14 are assembled to the upper receiver 4 by means of the barrel nut 16 as follows. First, the breech sleeve 76 is firmly mounted onto the barrel. Then, the barrel is inserted into the upper receiver from the rear and is moved forward through the chamber 25 until the guide ribs 130 of the breech sleeve engage into the guide slots 36 formed along the inner walls of the chamber 25. The guide slots and the guide ribs align the barrel and the breech sleeve with the upper receiver for proper operation of the magazine 10, the bolt group 20, and the action 22. The barrel is moved forward along the guide slots until the enlarged portion 68 fits into the breech insert 28 and the breech sleeve barrel face 129 rests firmly against the breech insert. Then, the forend is assembled over the barrel so that the tapered indents 85 of the forend fit snugly over the boss 38 and tabs 39 of the upper receiver. The barrel nut 16 is passed down the barrel from the muzzle within the forend and is tightened onto the threaded region of the barrel shoulder to clamp the breech sleeve and the forend against the breech insert and the upper receiver, respectively. The longitudinally tapered boss, tabs, and indents provide positive alignment of the forend with the upper receiver so that, among other benefits, the two portions of the hollow accessories rail are assembled in close alignment.

The charging handle 34 is assembled with the bolt group 20 and the assembled components then are inserted into the hollow accessories rail 33 and into the chamber 25 from the rear opening 26 of the upper receiver 4. The bolt group guide rails 99 fit into the guide slots 36 to align the bolt group with the rifled bore 64 of the barrel 12 and with the intended motions of the action 22. The charging handle slides into the hollow accessories rail. The bolt group is pushed forward until the forward ends of the bolt guide rails 99 fit into the guide notches 132 formed in the chamber face 128 of the breech sleeve 76.

The action 22 is assembled into the lower receiver 6 on the pivot pins 23 in an uncocked condition. With the bolt 100 resting against the breech sleeve 76 in the battery position, the upper receiver 4 is pivotally pinned to the lower receiver by inserting the forward pin 8*a* through the forward lug 24 and the ear 49*a*, and then is pivoted against the lower receiver to capture the buffer 98 against the forward wall of the butt tube 48 and to engage the hammer 112 between the bolt and the buffer. The rearward pin 8*b* is inserted through the rearward lug 24 and the holes 49*b* to complete assembly of the rifle 2.

To load the rifle 2, the magazine 10 is inserted into the magazine well 45, the charging handle 34 is actuated to charge the recoil spring 108 and to cock the action 22, and the charging handle is released to place the bolt 100 in battery position against the breech sleeve 76, thereby chambering a cartridge 62 from the magazine into the rifled bore 64 of the barrel 12. In operation, the rifle 2 is a semi-automatic blowback-operated weapon. Actuation of the trigger 116 moves the sear 114 against the sear spring 115 to release the hammer 112 from the cocked position, and the hammer spring 113 drives the hammer against the firing pin 102 to discharge the chambered round. The discharged casing blows back against the bolt, cycling the bolt group 20 and recocking the action. The operation can be repeated until the rear hook 63 of the magazine follower 56 engages the bolt catch 120, locking the bolt group in the charged position.

Advantageously, the present invention provides significant weight reduction and cost savings by forming the receivers and the magazine from polymer rather than metal. Additionally, the present invention improves cleanliness and reliability of operation by using blowback operation rather than gas operation. Another advantage of blowback operation is that a gas tube and bolt piston rings are no longer required, reducing manufacturing costs.

The present invention further reduces manufacturing costs by providing a captured bolt group housed entirely in the upper receiver, and by capturing the forend between the upper receiver and the barrel nut rather than using separate forend fasteners. By inserting the barrel from the rearward end of the upper receiver and clamping a forward surface of the breech sleeve against the breech insert, the present invention also strengthens the attachment of the barrel to the upper receiver.

By providing an upper neck to the magazine, the rifle provides an open bolt on the last round fired when using .22 LR ammunition in blowback operation.

Figure 10:
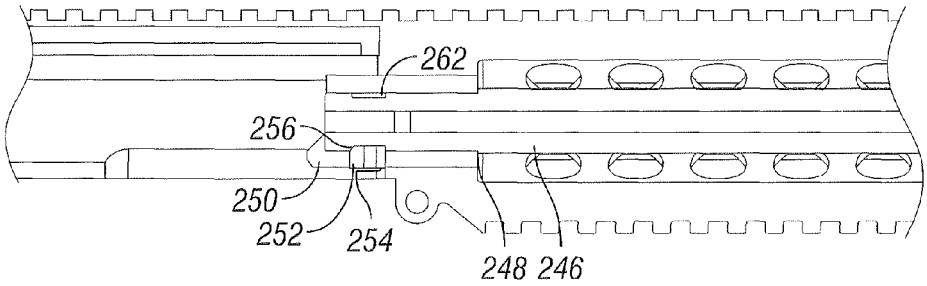
FIGS. 10-12 are sectional views of alternate embodiments of the present invention.
Figure 11:
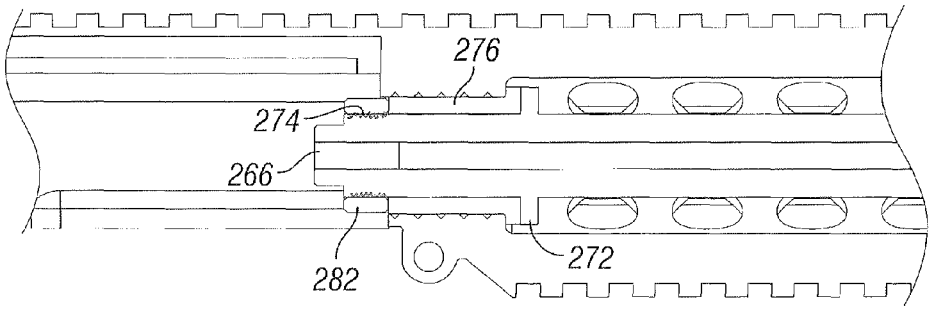
Figure 12:
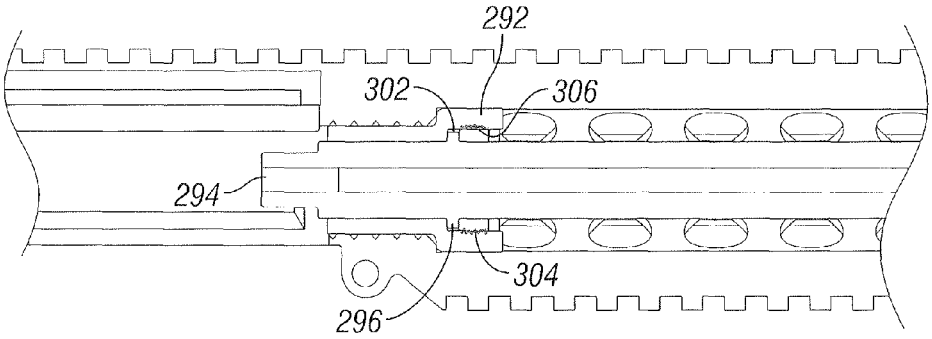

In other embodiments of the present invention, the upper receiver and forend may be integrally formed as a single injection-molded piece. For example, as shown in FIGS. 10-12, a barrel assembly may be inserted from the front of an integrally formed upper receiver and forend. In these alternate embodiments, no guide slots are required in the upper receiver bore.

In the embodiment shown in FIG. 10, a barrel 246 is formed with a shoulder 248 near a rearward barrel end. The barrel is inserted into an integrally-formed upper receiver and forend from the front, and the barrel shoulder engages a forward surface of an insert 250 molded into the receiver and forend. The insert houses a barrel retention block 252 that is adjustable relative to the insert by tightening or loosening screws 254 housed in internally-threaded holes of the insert. The barrel retention block has a tapered upper surface 256 that engages a tapered groove 262 formed on the barrel outer surface rearward of the shoulder.

In the embodiment shown in FIG. 11, a barrel 266 has a flange 272 and a threaded portion 274 formed near a rearward barrel end. The barrel is inserted into a receiver from the front, and the flange rests against a forward surface of a breech insert 276. A barrel nut 282 is tightened on the threaded portion of the barrel against a rearward surface of the breech insert, using a tool inserted through a rear opening of the receiver, until the barrel is firmly clamped to the breech insert.

In the embodiment shown in FIG. 12, a cupped breech insert 292 is molded into an integrally-formed receiver and forend. A barrel 294 is inserted from the front of the cupped insert so that a barrel flange 296 rests against a forward-facing surface 302 of the cupped insert. A barrel nut 304 then is tightened in a threaded inner surface 306 of the cupped insert, using a tool inserted through a forward opening of the integrally-formed receiver and forend, so as to clamp the barrel flange against the cupped insert forward-facing surface.

Although this invention has been shown and described with respect to the detailed embodiments thereof, it will be understood by those skilled in the art that various changes in form and detail thereof may be made without departing from the spirit and the scope of the invention.

What is claimed is:

1. A rifle frame comprising:

a receiver having an inner surface defining a chamber that extends from a rearward opening to a breech passage, the rearward opening and the breech passage being disposed coaxially along a central axis of the chamber and the breech passage being smaller in diameter than the chamber, and including a lower opening extending radially from the chamber through a lower side of said receiver rearward from the breech passage;

a barrel enclosing a bore extending from a breech end of the barrel to a muzzle end of the barrel, said barrel including an externally-threaded portion smaller in outer diameter than the breech passage of said receiver and disposed proximate the breech end of said barrel, a shoulder larger in diameter than the breech passage and disposed substantially adjacent to the externally-threaded portion, and a feed ramp extending downward and rearward from the breech end of said barrel adjacent to the bore; and a barrel nut having an internally threaded opening dimensioned to engage the externally-threaded portion of said barrel, the barrel nut being larger in outer diameter than the breech passage of said receiver, wherein the externally-threaded portion of said barrel is inserted through the breech passage of said receiver and said receiver is clamped against the shoulder of said barrel by threaded engagement of said barrel nut onto the externally-threaded portion of said barrel to sandwich the receiver between the shoulder and the barrel nut.

2. The rifle frame as claimed in claim 1, wherein the inner surface of said receiver includes laterally-opposed guide slots extending from the rearward opening to the breech passage substantially parallel to the central axis of the chamber.

3. The rifle frame as claimed in claim 2, wherein the shoulder of said barrel includes radially-protruding ribs fitted into the guide slots formed along the inner surface of said receiver, the ribs and the guide slots cooperating to align the feed ramp of said barrel with the lower opening of said receiver.

4. The rifle frame as claimed in claim 3, wherein said barrel further includes radial notches indented into the breech end of said barrel in alignment with the radially-protruding ribs formed on the shoulder of said barrel.

5. The rifle frame as claimed in claim 1, wherein the inner surface of said receiver also includes an upwardly-indented recess extending from the rearward opening toward the breech passage substantially parallel to the central axis of the chamber.

6. The rifle frame as claimed in claim 5, wherein the outer surface of said receiver includes an upwardly-protruding rail enclosing the upwardly-indented recess formed in the inner surface of said receiver.

7. The rifle frame as claimed in claim 1, further comprising a forend clamped between said receiver and said barrel nut, said forend extending forward from said receiver and surrounding at least a portion of said barrel.

8. The rifle frame as claimed in claim 7, the outer surface of said receiver including a main portion extending forward from the rearward opening to surround at least a rearward portion of the breech passage and including an annular boss protruding forward from the main portion to surround the remainder of the breech passage, said forend including a circular recess indented into the rearward end of said forend for assembly onto the annular boss of said receiver.

9. The rifle frame as claimed in claim 8, the outer surface of said receiver further including a rail protruding upward along the main portion of the outer surface and including tapered tabs protruding radially outward from the annular boss adjacent to the main portion of the outer surface, said forend further including tapered indents indented radially outward from the circular recess for assembly onto the tapered ribs, said forend including at least one rail protruding outward along said forend and the tapered indents and the tapered ribs cooperating to align the rail of said forend to the rail of said receiver.

10. The rifle frame as claimed in claim 1, said barrel including a reduced-outer-diameter portion immediately adjacent to the breech end of said barrel, the shoulder of said barrel being formed by a breech sleeve fastened onto the reduced-outer-diameter portion, and the externally-threaded portion of said barrel being disposed muzzleward from the reduced-outer-diameter portion, wherein said breech sleeve includes the feed ramp.

11. The rifle frame as claimed in claim 1, said receiver including an upper portion enclosing the chamber and the breech passage with a lug protruding from a lower surface of the upper portion adjacent to the breech passage, a lower portion enclosing an action group cavity with an ear protruding from a forward surface of the lower portion, and a pin inserted through the lug and the ear to pivotally connect the upper portion to the lower portion, the chamber and the action group cavity being mutually opened to each other and the lower opening being formed through the lower portion of said receiver between the action group cavity and the ear.

12. The rifle frame as claimed in claim 1, further comprising a breech insert molded into the breech passage of said receiver.

13. The rifle frame as claimed in claim 12, said receiver being formed of a first material that is relatively malleable and impact-resistant as compared to a second material from which said breech insert is formed.

14. The rifle frame as claimed in claim 1, wherein the externally-threaded portion of said barrel is disposed between the breech end of said barrel and the shoulder of said barrel.

15. A rifle comprising:

a rifle frame having a receiver with an inner surface defining a chamber that extends from a rearward opening to a breech passage, the rearward opening and the breech passage being disposed coaxially along a central axis of the chamber and the breech passage being smaller in diameter than the chamber, and including a lower opening extending radially from the chamber through a lower side of said receiver rearward from the breech passage;

a barrel enclosing a bore extending from a breech end of the barrel to a muzzle end of the barrel, said barrel including an externally-threaded portion smaller in outer diameter than the breech passage of said receiver and disposed proximate the breech end of said barrel, a shoulder larger in diameter than the breech passage and disposed substantially adjacent to the externally-threaded portion, and a feed ramp extending downward and rearward from the breech end of said barrel adjacent to the bore; and a barrel nut having an internally threaded opening dimensioned to engage the externally-threaded portion of said barrel, the barrel nut being larger in outer diameter than the breech passage of said receiver, wherein the externally-threaded portion of said barrel is inserted through the breech passage of said receiver and said receiver is clamped against the shoulder of said barrel by threaded engagement of said barrel nut onto the externally-threaded portion of said barrel, wherein the inner surface of the receiver of said rifle frame includes laterally-opposed guide slots extending from the rearward opening to the breech passage substantially parallel to the central axis of the chamber and includes sidewalls enclosing a lower cavity below the guide slots, the shoulder of the barrel of said rifle frame includes radially-protruding ribs fitted into the guide slots formed along the inner surface of the receiver, the ribs and the guide slots cooperating to align the feed ramp of the barrel with the lower opening of the receiver, and the barrel further includes radial notches indented into the breech end of the barrel in alignment with the radially-protruding ribs formed on the shoulder of the barrel;

a bolt group including a buffer, guide rails extending along and forward from the buffer, a bolt slidingly mounted on the guide rails, a firing pin slidingly housed within the bolt, a recoil rod slidingly housed within the bolt and releasably clipped to the buffer, and a recoil spring captured on the recoil rod between the buffer and the bolt, said bolt group being inserted into said rifle frame with the guide rails fitted into the guide slots of the receiver of said rifle frame and into the radial notches of the barrel of said rifle frame, and the bolt being movable along the guide rails from a battery position distal from the buffer and proximate the shoulder of the barrel of said rifle frame to a charged position proximate the buffer;

an action mounted in the lower cavity of the receiver of said rifle frame and including a hammer pivotally mounted on a first pin extending between the sidewalls of the receiver for motion between a cocked position and a discharged position, a hammer spring connected between the hammer and one of the sidewalls of the receiver for biasing the hammer toward the discharged position, a sear pivotally mounted on a second pin extending between the sidewalls of the receiver for motion between a locked position restraining the hammer and a released position not contacting the hammer, a sear spring connected between the sear and one of the sidewalls of the receiver to bias the sear toward the locked position, and a trigger pivotally mounted on a third pin extending between the sidewalls of the receiver, the trigger being movable to force the sear out of the locked position, said action being disposed with respect to said bolt group such that motion of the bolt of said bolt group from the battery position to the charged position moves the hammer and the sear to the cocked and locked positions;

a bolt catch pivotally mounted in the receiver of said rifle frame and movable between a retracted position and an extended position in which said bolt catch restrains the bolt of said bolt group in the charged position; and a magazine releasably inserted into the lower opening of the receiver of said rifle frame such that motion of the bolt of said bolt group from the charged position to the battery position feeds a round from said magazine into the bore of the barrel of said rifle frame, said magazine including a case housing a follower and a spring for urging the follower toward an emptied position at the top of the case, the follower having a rearwardly-protruding hook, wherein the rearwardly-protruding hook moves said bolt catch to the extended position when the follower is in the emptied position.

16. The rifle as claimed in claim 15, wherein the follower of said magazine is dimensioned to carry one or more .22 LR rounds in a single stack and the case of said magazine includes a lower portion dimensioned to appear as a 5.56 mm NATO magazine and includes an upper portion dimensioned to closely fit the follower and to position an uppermost of the .22 LR rounds in line with said bolt group when said magazine is fully inserted into the lower opening of the receiver of said rifle frame, wherein the lower opening of the receiver of said rifle frame is dimensioned to releasably engage the lower portion of the case of said magazine, and wherein the feed ramp of the barrel of said rifle frame is angled and dimensioned to convey the uppermost of the .22 LR rounds from said magazine to the bore of the barrel when the bolt of said bolt group moves from the charged position to the battery position.

17. A rifle frame comprising:

a receiver having an inner surface defining a chamber that extends from a rearward opening to a breech opening, the rearward opening and the breech opening being disposed coaxially along a central axis of the chamber, and including a lower opening extending radially from the chamber through a lower side of said receiver rearward from the breech passage;

a breech insert molded into the breech opening of said receiver and having a breech passage formed therethrough, the breech passage being smaller in diameter than the chamber of said receiver, said breech insert including an internally threaded portion extending from the breech passage;

a barrel enclosing a bore extending from a breech end of the barrel to a muzzle end of the barrel, said barrel including a breech end portion smaller in outer diameter than the breech passage of said breech insert and including a shoulder larger in diameter than the breech passage of said breech insert and disposed substantially adjacent to the breech end portion of said barrel; and an externally-threaded fastener engageable with the internally-threaded portion of said breech insert, wherein the breech end portion of said barrel is inserted through the breech passage of said breech insert and said breech insert is clamped against the shoulder of said barrel by threaded engagement of said externally-threaded fastener into the internally-threaded portion of said breech insert.

18. The rifle frame as claimed in claim 17, wherein the internally-threaded portion of said breech insert is disposed coaxially with and adjacent to the breech passage and said externally-threaded fastener is assembled over said barrel and directly contacts the shoulder of said barrel when threadedly engaged into the internally-threaded portion of said breech insert.

* * * * *